US006601591B1

(12) United States Patent
Carullo et al.

(10) Patent No.: US 6,601,591 B1
(45) Date of Patent: Aug. 5, 2003

(54) ERGONOMIC COSMETIC APPLICATOR

(75) Inventors: Anne Carullo, Ramsey, NJ (US); James Gager, New York, NY (US); Brenan Liston, New York, NY (US)

(73) Assignee: Color Access, Inc., Melville, NY (US)

( * ) Notice: Subject to any disclaimer, the term of this patent is extended or adjusted under 35 U.S.C. 154(b) by 0 days.

(21) Appl. No.: 09/646,636

(22) PCT Filed: Mar. 27, 1998

(86) PCT No.: PCT/US98/06117

§ 371 (c)(1),
(2), (4) Date: Sep. 20, 2000

(87) PCT Pub. No.: WO99/48403

PCT Pub. Date: Sep. 30, 1999

(51) Int. Cl.[7] ..... A45D 40/26
(52) U.S. Cl. ..... 132/320
(58) Field of Search ..... 132/320, 317, 132/333; 15/244.1, 244.3, 244.4, 104.001, 104.93, 209.1, 229.14; D32/40; D28/7, 8

(56) References Cited

U.S. PATENT DOCUMENTS

D74,968 S * 4/1928 Danielson ..... D28/8
2,030,911 A * 2/1936 Borden ..... 15/244.1
2,037,944 A * 4/1936 Steinhardt ..... 15/209.1
2,841,811 A * 7/1958 Carroll ..... 15/244.1
2,904,814 A * 9/1959 Scholl ..... 15/244.1
D206,641 S * 1/1967 Hill ..... 132/320
3,317,944 A * 5/1967 Napier et al. ..... 15/244.1
3,472,242 A * 10/1969 Demner ..... 132/333
3,863,654 A * 2/1975 Morane et al. ..... 132/320
3,864,778 A * 2/1975 Vopat et al. ..... 15/105
4,619,014 A * 10/1986 Piken ..... 15/244.1
4,887,994 A * 12/1989 Bedford ..... 132/317
D379,698 S * 6/1997 Freudenberg et al. ..... D32/40
D392,433 S * 3/1998 Norris ..... D32/40

* cited by examiner

*Primary Examiner*—Eduardo C. Robert
(74) *Attorney, Agent, or Firm*—Peter Giancana

(57) ABSTRACT

An ergonomic cosmetic applicator designed to work with the contours of the face. The applicator comprises at least five surfaces: one upper surface, one lower surface, and at least three lateral surfaces, wherein one lateral surface is concave in shape, one lateral surface is substantially linear or flat in shape, and any two lateral surfaces meet to form a tip portion. The lateral concave surface allows precision application of a makeup, for example, to the outer side of the face, under the jawline, and under the eye. The lateral linear or flat surface of the applicator enables application of the makeup to the flat surfaces of the face, such as the cheek. The tip portion allows the consumer to reach into the corners of the eye, and around the mouth and nose.

7 Claims, 2 Drawing Sheets

ERGONOMIC COSMETIC APPLICATOR

FIELD OF THE INVENTION

The present invention relates to cosmetic applicators. More particularly, it relates to cosmetic applicators which, by the shape and angles of intersection of the surfaces, are ergonomically and anatomically designed to provide precisely controlled application of a makeup product to the face.

BACKGROUND OF THE INVENTION

Cosmetic sponge or puff applicators are typically shaped so that they can fit within a cosmetic compact. Generally, these applicators are round, square, rectangular, teardrop, or wedge shaped. These traditional design applicators are not shaped for ease of use, but rather for ease of packaging within a compact.

The use of these traditionally designed applicators by the consumer has certain drawbacks. In order for a consumer to be able to effectively use a traditionally designed applicator for applying a makeup foundation, for example, the consumer is required to manipulate and distort the applicator to accommodate each of the varying contours of the face. This constant manipulation of the applicator increases the amount of time required for proper application of the intended makeup product.

The present invention overcomes the disadvantages associated with the traditionally designed cosmetic applicators by providing an ergonomically shaped applicator which is designed to work with the contours of the face, thus enabling the controlled application of a makeup product.

SUMMARY OF THE INVENTION

The present invention is an ergonomic cosmetic applicator designed to work with the contours of the face. The applicator comprises at least five surfaces: one upper surface, one lower surface, and at least three lateral surfaces, wherein one lateral surface is concave in shape, one lateral surface is substantially linear or flat in shape, and any two lateral surfaces meet to form a tip portion. The lateral concave surface allows precision application of a makeup, for example, to the outer side of the face, under the jawline, and under the eye. The lateral linear or flat surface of the applicator enables application of the makeup to the flat surfaces of the face, such as the cheek. The tip portion allows the consumer to reach into the corners of the eye, and around the mouth and nose.

BRIEF DESCRIPTION OF THE DRAWINGS

Further objects, features and drawings of the present invention will better be understood in light of the embodiment examples which are discussed below with the aid of a drawing wherein.

DETAILED DESCRIPTION OF THE INVENTION

Figure 1:
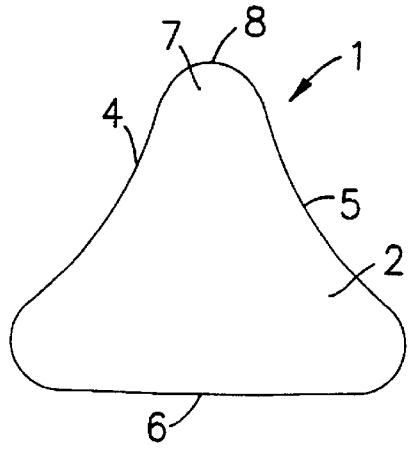
FIG. 1 is a top view of one embodiment of the applicator of the present invention.
Figure 2:
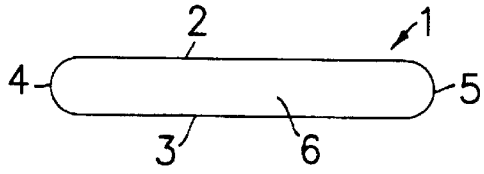
FIG. 2 is a side view of the applicator of FIG. 1.

Referring now to the drawings, FIGS. 1 and 2 show the cosmetic applicator 1 of the present invention. The applicator 1 has one upper surface 2, one lower surface 3, and at least three lateral surfaces 4, 5, and 6, wherein any two of the lateral surfaces meet to form a tip portion 7. Preferably, the applicator 1 has only three lateral surfaces, giving an overall triangular appearance to the applicator. These three lateral surfaces, when combined together, provide a single applicator capable of effectively applying makeup to all areas of the face.

The first lateral surface 4 of the applicator is concave in shape. Preferably, one or more lateral surfaces of the applicator are concave in shape. Most preferably, when the applicator is triangular in shape as in FIG. 1, the first lateral surface 4 and second lateral surface 5 of the applicator are concave. The lateral concave surface 4 of the applicator allows the consumer to easily apply makeup to the outer side of the face, under the jawline, and under the eye without the consumer having to further manipulate the shape of the applicator.

A third lateral surface 6 of the applicator is substantially linear or flat in shape. This lateral surface 6 allows the consumer to apply makeup to the flat surfaces of the face, such as the cheek. Also, when this linear surface 6 is combined with either the upper surface 2 or the lower surface 3, an ample surface area with which to apply or blend the makeup on the skin is provided.

The applicator 1 is further provided with a tip portion 7. This portion 7 is defined by the intersection of any two lateral surfaces of the applicator at an angle less than 90 degrees. As seen in FIG. 1, lateral surface 4 and 5 intersect to form the tip portion 7. The tip portion 7 enables the consumer to reach into the corners of the eye, and around the mouth and nose. Having this portion incorporated into the design allows the consumer to utilize the applicator without having to bend, contort, or otherwise deform the applicator in order to apply makeup to the hard to reach areas of the face that generally require a smaller applicator surface for proper application. Preferably, the tip portion 7 has a rounded edge 8, as seen in FIG. 1.

Figure 3:
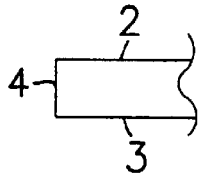
FIGS. 3 through 5 are partial side views of the lateral surface having various profiles.
Figure 4:
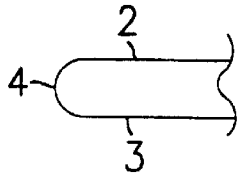
Figure 5:
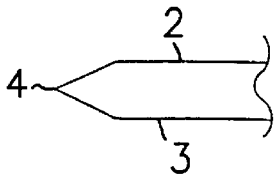

As seen in FIGS. 3, 4, and 5, the lateral surfaces (4, 5, and 6) of the applicator can be provided with various profiles, such as flat, round, or angled. The choice of which profile to use will depend upon the type of makeup product which is intended to be applied by the applicator. For example, if the product is a creme foundation, then the profile of the lateral surfaces would preferably be angled, as seen in FIG. 5. The angled surface provides a larger applicator surface area for collecting product on the lateral surfaces before application. When an angled surface is used, the angled surface can be flared outward from either the upper surface 2, the bottom surface 3, or both as seen in FIG. 5 If the product is a pressed powder, then the profile of the lateral surfaces would preferably be rounded, as in FIG. 4.

Figure 6:
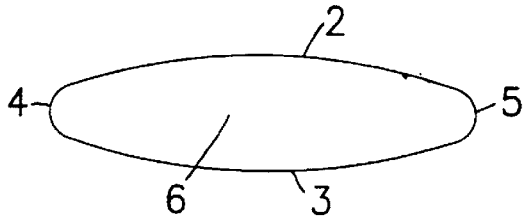
FIG. 6 is a side view of the applicator of the present invention with convex shaped upper and lower surfaces.
Figure 7:
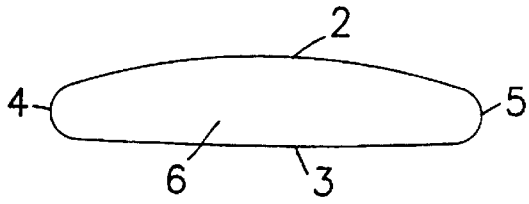
FIG. 7 is a side view of the applicator of the present invention with a convex shaped upper surface.
Figure 8:
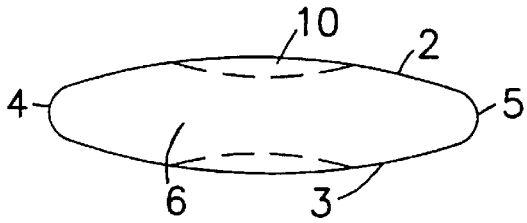
FIG. 8 is a side view of the applicator of the present invention with a finger recess provided on the each of the convex upper and lower surfaces.
Figure 9:
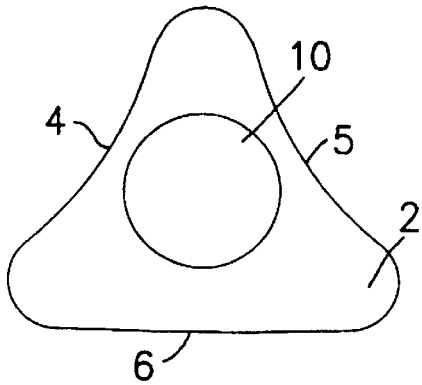
FIG. 9 is a top view of the applicator of FIG. 8.

Additionally, as seen in FIGS. 6 and 7, the upper surface 2 and lower surface 3 of the applicator can be of varying design. Either the upper surface 2, the lower surface 3, or both, are flat or convex in design. By making either the upper surface 2 or the lower surface 3 convex in design imparts a greater thickness to the applicator, making handling of the applicator by the consumer simpler. Additionally, either the upper surface 2, the lower surface 3, or both, can further be provided with a finger recess 10, as seen in FIGS. 8 and 9. The finger recess 10 allows the consumer to retain a more secure grip on the applicator during use.

Common materials used in the manufacture of cosmetic applicators include rubbers, such as latex (polyisoprene), neoprene, nitrile-butadiene rubber (NBR), styrene-butadiene rubber (SBR), and the like; foamed plastics, such as polyurethane, polyethylene, polypropylene, and the like; natural sponge materials; and flocked fabrics, for example, a cotton fabric puff with nylon flocking, velour flocking, or a felt coating.

The invention, and its broader aspects, is not limited to the specific details shown and described; rather, various modifications will be suggested to one skilled in the art, all of which are within the scope of this invention.

What is claimed is:

1. An ergonomic cosmetic applicator comprising at least five application surfaces, wherein:

one surface is an upper surface;

one surface is a lower surface; and three surfaces are lateral surfaces, at least one lateral surface being concave such that a portion of a user's face can be received into the concave surface, at least one lateral surface being substantially linear, at least one lateral surface having an angled profile and any two of the lateral surfaces intersecting at an angle less than ninety degrees to form a rounded tip portion.

2. An ergonomic cosmetic applicator as in claim 1 wherein the applicator is triangular in shape.

3. An ergonomic cosmetic applicator as in claim 1 wherein the applicator is comprised of a material chosen from the group consisting of rubbers, foamed plastics, natural sponges, and flocked fabrics.

4. An ergonomic cosmetic applicator as in claim 3 wherein the material comprising the applicator is chosen from the group consisting of nitrile-butadiene rubber, styrene-butadiene rubber, latex rubber, neoprene, polyurethane, polyethylene, polypropylene, nylon flocked fabric, and cofton flocked fabric.

5. An ergonomic cosmetic applicator as in claim 1 wherein the upper surface, the lower surface, or both the upper surface and the lower surface are substantially flat.

6. An ergonomic cosmetic applicator as in claim 1 wherein the upper surface, the lower surface, or both the upper surface and the lower surface are convex.

7. An ergonomic cosmetic applicator comprising at least five application surfaces, wherein one surface is an upper surface and one surface is a lower surface, such that the upper surface, the lower surface, or both the upper surface and the lower surface are provided with a finger recess; and three surfaces are lateral surfaces, wherein at leastoe lateral surface is concave, at least one lateral surface is substantially linear and any two of the lateral surfaces intersect at an angle less than ninety degrees to form a rounded tip portion.

* * * * *